US006926142B2

(12) United States Patent
Powers et al.

(10) Patent No.: US 6,926,142 B2
(45) Date of Patent: Aug. 9, 2005

(54) PRODUCT PACKAGING STRUCTURE

(75) Inventors: Joshua H. Powers, Bristol, TN (US); Mark H. Marvis, Bristol, VA (US); Hugh C. Stringer, Bristol, VA (US)

(73) Assignee: Triad Packaging, Inc., Bristol, TN (US)

( * ) Notice: Subject to any disclaimer, the term of this patent is extended or adjusted under 35 U.S.C. 154(b) by 76 days.

(21) Appl. No.: 10/397,391

(22) Filed: Mar. 26, 2003

(65) Prior Publication Data

US 2004/0188306 A1 Sep. 30, 2004

(51) Int. Cl.[7] ..... B65D 85/46
(52) U.S. Cl. ..... 206/321; 206/600; 211/59.4
(58) Field of Search ..... 206/321, 325, 206/386, 600, 449, 554, 503; 211/50, 59.4, 186, 188; 220/4.26, 4.28; 229/919

(56) References Cited

U.S. PATENT DOCUMENTS 1,760,309 A * 5/1930 Marrits ..... 211/59.4
3,253,707 A * 5/1966 Gooding ..... 206/600
3,422,564 A * 1/1969 Izumi ..... 206/821
3,734,281 A * 5/1973 Armstrong ..... 206/321
5,161,703 A * 11/1992 Patton ..... 211/59.4
5,344,014 A * 9/1994 Toral et al. ..... 206/386
5,636,753 A * 6/1997 Wilkinson et al. ..... 211/59.4
6,119,861 A * 9/2000 Schneider ..... 206/821

* cited by examiner

*Primary Examiner*—Luan K. Bui

(57) ABSTRACT

A package unit of product and packaging structure wherein the product is stacked in layers and wherein a divider of fairly rigid heavy corrugated paper board is interposed between each layer, wherein each divider is provided at each of its side edges with at least two tabs projecting laterally outwardly therefrom, each tab having an aperture formed therethrough, wherein the apertures of stacked (superimposed) dividers are vertically aligned, wherein posts are inserted frictionally thru the aligned apertures, and wherein the stack of layered product and dividers is laterally banded.

10 Claims, 2 Drawing Sheets

PRODUCT PACKAGING STRUCTURE

BACKGROUND OF THE INVENTION

1. Field

This invention involves improvements in packaging for handling and transporting relatively lightweight and flexible products such as extruded plastic or fiberglass molding strips, deck planks, or the like which, when in substantial lengths of, e.g., 8 ft. or more, may tend to droop or bend excessively particularly when stacked on pallets and lifted by fork lift trucks or the like. Such flexing makes it very difficult to stack the products in such a manner as to protect them from damage or to stack them to a height which affords cost efficient storage or transport thereof.

2. Prior Art

Heretofore such products have been packaged in large wood framed structures or crates of, e.g., 2×4 lumber including 3 or 4 long runners on the bottom and offtimes with no product confining sides. Such crates are heavy, expensive, time consuming to assemble by screws, nails or bolts, difficult to load the product items thereinto, difficult to dispose of after use, difficult to take apart where reuse or recycling of the lumber is attempted, and difficult to handle, store or ship in stacked units. Moreover, such crates do not provide structure which can protect specialty items from abrasive or impact damage which can occur during loading or unloading of the items into bundles for shipment, storage or on the job use.

The present packaging invention on the other hand does not have such disadvantages and provides support and damage protection for such products substantially throughout their lengths and allows rapid and unhindered high stacking of the products without fear of damage thereto or dislocation thereof from the stack during lifting, storage and transport.

SUMMARY OF THE INVENTION

The present package unit of product and packaging structure utilizes the stacking of product in layers and wherein the packaging structure comprises at least one divider of fairly rigid sheet material such as corrugated paper board, or plastic sheet, either solid or open or closed cellular composition, interposed between each said product layer, wherein each divider is provided at each of its side edges with at least two tabs projecting generally laterally outwardly therefrom, each said tab having an aperture formed therethrough normal to the general plane of the divider, wherein the apertures of superimposed dividers are vertically aligned, wherein posts are inserted frictionally thru the aligned apertures, and wherein the stack of layered product and dividers is laterally banded to further strengthen the stack and maintain the integrity thereof.

It is noted that structures defined herein by the various terms such as "horizontally", vertically", "general plane" and the like are to be construed with reference to their postures and orientations depicted on the drawings relative to adjacent structures.

In certain preferred embodiments:

(a) each said sheet is formed with two tabs adjacent each end thereof, and adjacent ones of said dividers are overlapped at their adjacent ends such that the apertures in the adjacent tabs of the overlapped dividers are aligned and receive the same posts;

(b) the stack of layered product and dividers is laterally banded whereby a top and/or bottom sheet are sufficiently deformed at their side edges within the area of said aligned apertures to frictionally, strongly bind the posts against the divider edges defining said aligned apertures;

(c) said product comprises long flexible items whereby said dividers provide significant longitudinal support thereto, wherein the unit is positioned on one or more fork lift pallets wherein the edges of the pallets lie inside of the side edges of the dividers, wherein the posts extend vertically above the top most divider, and the tine cavities of the pallets are oriented either laterally or longitudinally of the unit; and (d) one or more of the units are in vertically stacked arrangement wherein the dividers of an overlying unit are longitudinally staggered with respect to the dividers of an underlying unit such that the posts of the stacked units do not interfere with each other.

BRIEF DESCRIPTION OF THE DRAWINGS

The invention will be further understood from the following description and drawings wherein the figures are not drawn to scale or in actual dimensioned proportions, and wherein.

DETAILED DESCRIPTION

Figure 1:
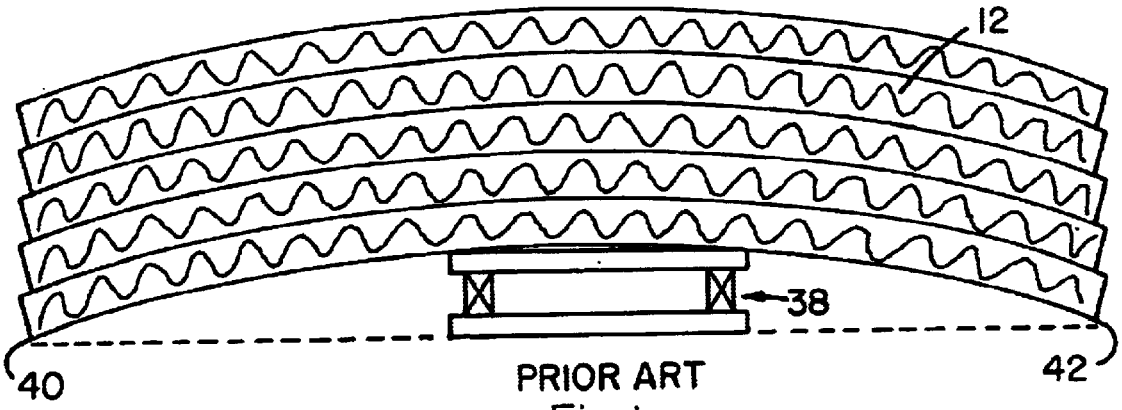
PRIOR ART Fig. 1
FIG. 1 is a side view of a bundle or stack of elongated, flexible product supported on a fork lift pallet in a conventional manner.
Figure 2:
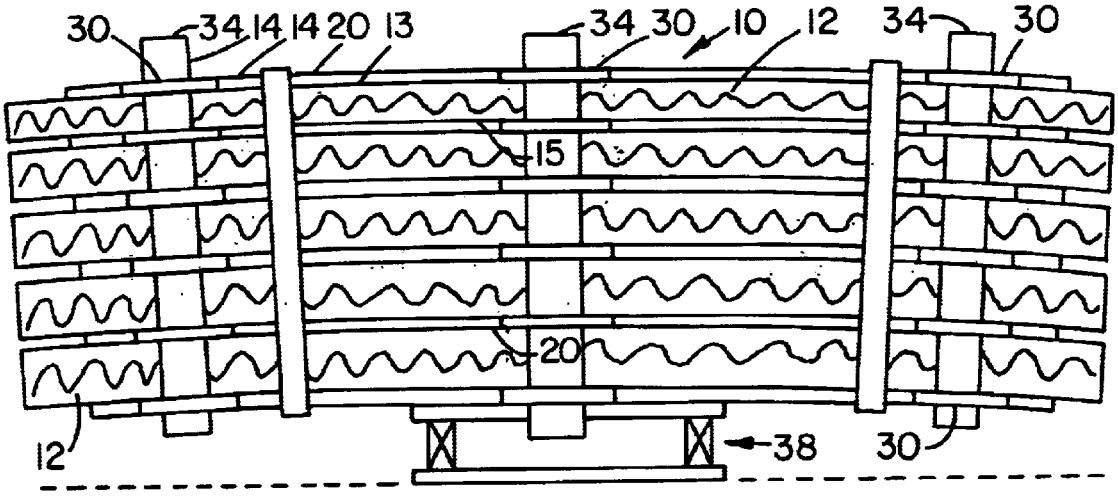
FIG. 2 is a side view as in FIG. 1 showing a stack employing the present packaging structure wherein each divider is comprised of a single sheet.

Referring to the drawings and with particular reference to the claims hereof, the present package unit is generally designated 10 and comprises a bundle of product 12 and a packaging structure generally designated 14 wherein the product is substantially vertically stacked in layers and wherein the upper 13 and lower 15 surfaces of each layer are substantially planar, wherein said packaging structure comprises a divider 20, preferably of rigid corrugated paper board interposed between each said product layer and having opposing side edges 22, 24 and end edges 26,28 wherein each divider is provided at each side edge with at least two tabs 30 projecting laterally outwardly therefrom, each said tab having an aperture 32 formed therethrough, wherein the apertures of stacked dividers are vertically aligned, wherein posts 34 are inserted frictionally thru the aligned apertures, and wherein the stack of layered product and dividers is laterally banded as shown for example at 36.

Dividers 20 are cut to any dimension needed for a particular product and typically range from about 28 in. to 10 ft or more in length, from about 2½ to about 4 ft. in width, and are provided with any desired number of tabs 30 as required for a particular load weight. The smaller lengths are more desirable from the standpoint of ease of handling and cost of shipping the dividers to the end user.

The thickness of the corrugated board or plastic sheet or the like, and its strength and weight may, of course, be varied according to the package requirements. A two ply (two corrugated layers) corrugated board showing a density of about 3–4 ounces/ft$^2$ makes a sturdy package of great utility for the present invention.

Figure 6:
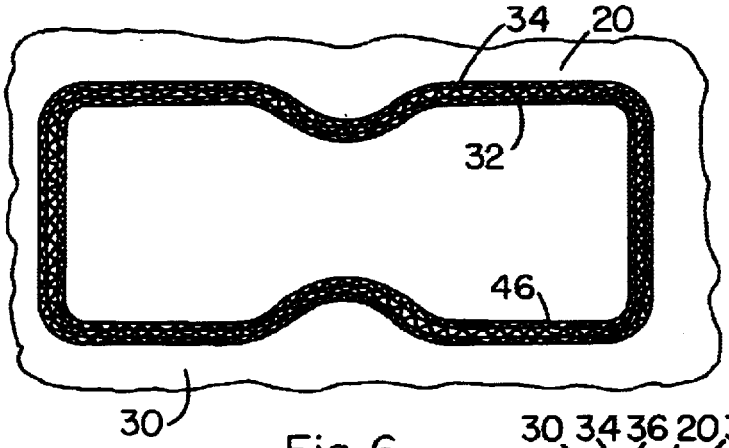
FIG. 6 is a cross-sectional view of a preferred form of post showing its multi-laminated construction.

The posts 34 can be of any lightweight but strong material, preferably of laminated fiberglass cloth, cardboard or the like adhesively bonded into a strong laminate as shown in FIG. 6. These posts preferably are cut to a length of, e.g., about 30 in. to accommodate a stack of product which is of a handleable weight. A typical post would weigh from about 10 to about 20 ounces. It is preferred that the posts extend a sufficient distance above the topmost sheet to allow an operator to pull the posts out of the aligned row of apertures after the bands 36, should they be employed, have been released.

As seen in FIG. 1, long pieces of product 12, e.g., 12–20 ft., such as extruded planks or plastic moldings will typically droop over the pallet 38, often even when the load (bundle) is banded, to an extent that the ends 40, 42 of the load will fall below the floor level or the level of the base of a storage or transport rack or platform. Such an event can greatly hinder or prevent proper placement of the package unit on the rack or platform or on an underlying product bundle, with of course, attendant danger to the operator from dislocation of the bundle, offtimes at substantial elevation above the forklift truck.

Figure 3:
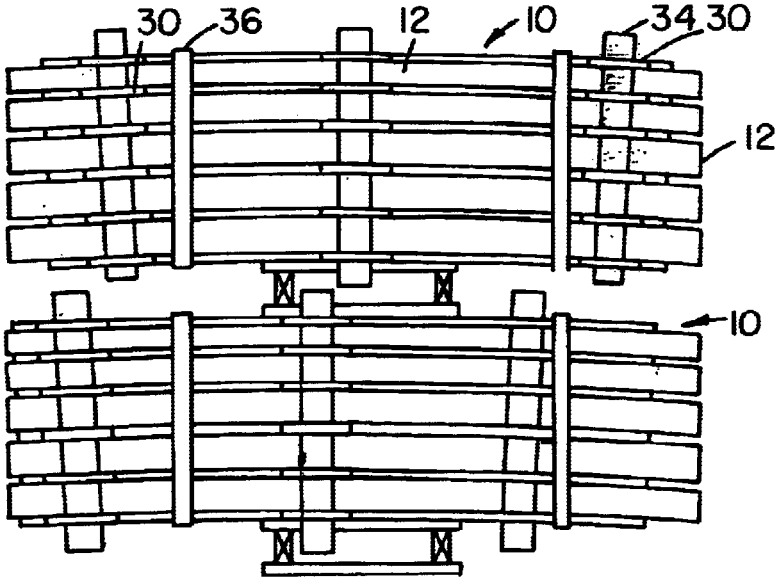
FIG. 3 is a side view as in FIG. 2 and showing stacked units.

As shown in FIG. 3, the present package units, resting on a single pallet for many applications, can be stacked easily without fear to the operator of striking a lower unit with drooping ends of the product bundle. It is noted that for this embodiment, it is preferred to so position the dividers lengthwise on the product bundle that the top ends of the posts of the lower unit do not align and interfere with the bottom ends of the posts of the upper unit.

Figure 4:
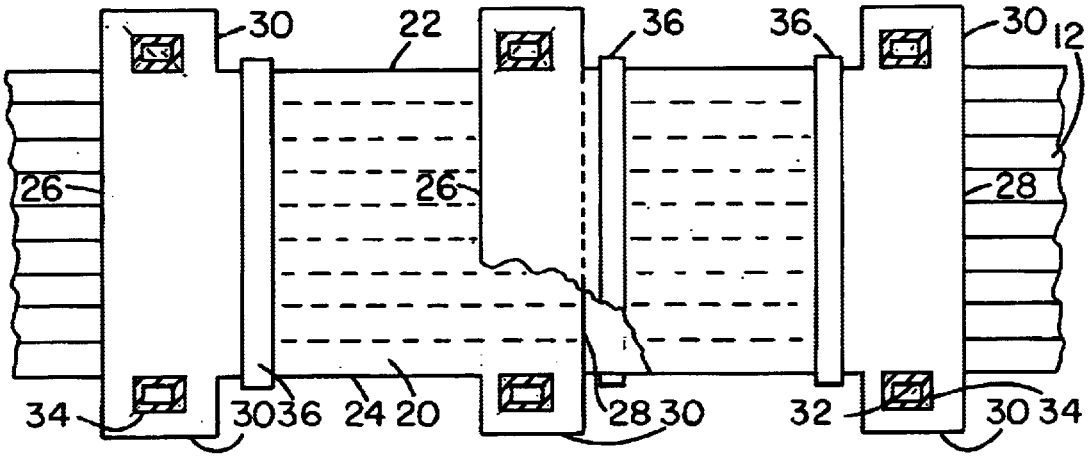
FIG. 4 is a top view as in FIG. 2 wherein the dividers are relatively short and are overlapped at adjacent ends.
Figure 7:
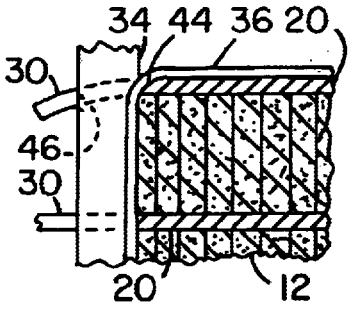
FIG. 7 is an enlarged cross-sectional view of the area 7—7 of FIG. 5 showing desirable deformation (somewhat exaggerated) of the topmost divider side edge against a post caused by banding the product bundle.
Figure 8:
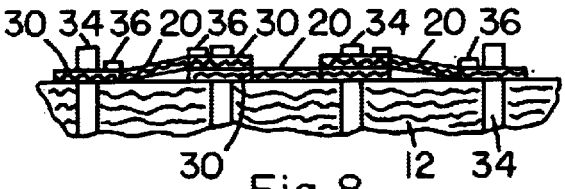
FIG. 8 is a side view of a unit showing an alternative way to that of FIG. 4 for overlapping the divider ends and with the banding in cross-section.
Figure 5:
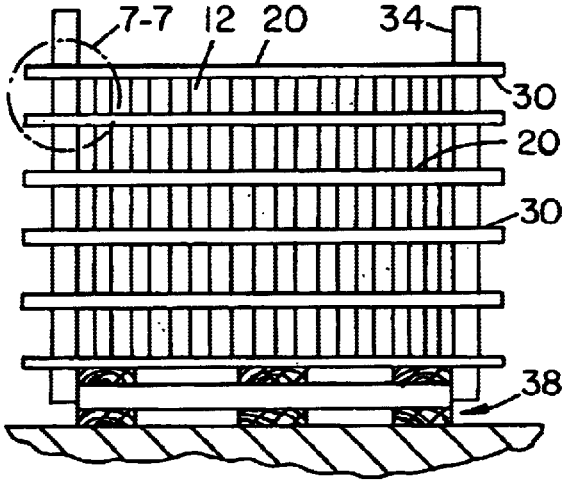
FIG. 5 is an end view of the unit of FIG. 2 without the banding.
Figure 9:
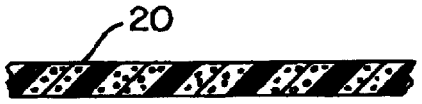
FIG. 9 is a cross-sectional view of a portion of a closed cell plastic sheet useful for the present invention as a divider.

Referring to FIG. 7 where the bands 36 are positioned close to the posts as, e.g., in FIG. 4, the banding will deform the side edges of the topmost divider as at 44, and similarly also of the bottom divider, and will result in a tightening of the edge 46 of tab 30 which forms aperture 32, against post 34. Such tightening will enhance the overall strength and rigidity of the package unit.

This invention has been described in detail with particular reference to preferred embodiments thereof, but it will be understood that variations and modifications will be effected within the spirit and scope of the invention.

We claim:

1. A package unit of product and packaging structure wherein the product is of substantial length and is relatively lightweight and flexible such as extruded plastic or fiberglass molding strips, deck planks, or the like which will tend to droop at its ends when stacked on pallets, wherein said product is vertically stacked in layers and wherein the upper and lower surfaces of each layer are substantially planar, said packaging structure comprising a divider of fairly rigid material interposed between each said layer and having opposing sides edges and end edges, each said divider being provided at each of its side edges with at least two tabs projecting laterally outwardly therefrom, each said tab having an aperture formed therethrough, said apertures of superimposed dividers being vertically aligned and posts being inserted frictionally thru the aligned apertures, wherein a plurality of dividers are employed for each layer and are overlapped at their adjacent end edges such that the apertures in the adjacent tabs of the overlapped dividers are aligned and receive the same posts, wherein said divider material is heavy corrugated paper board having a density of from about 2.5 to about 4.0 oz./ft$^2$, and wherein the stack of layered product and dividers is laterally banded whereby a topmost divider and a bottom divider of the stack are sufficiently deformed to frictionally and strongly bind the posts against the edges of the apertures of said topmost and bottom dividers.

2. The unit of claim 1 wherein each divider is from about 30 in. to about 36 in. long with two tabs per side edge.

3. The unit of claim 2 wherein each post is hollow core and formed with 3–7 layers of cardboard material, which layers are glued together to form a lightweight rigid structure.

4. The unit of claim 2 wherein said product comprises long flexible items whereby said dividers in overlapped configuration provide substantial longitudinal support thereto.

5. The unit of claim 1 positioned on at least one fork lift pallet wherein the edges of the pallet lie inside of the side edges of the dividers, wherein the posts extend above a topmost divider and below a bottom divider, and wherein the tine cavities of the pallet are oriented either laterally of longitudinally of the unit.

6. A combination of one or more of the units of claim 5 in vertically stacked arrangement wherein the dividers of an overlying unit are longitudinally staggered with respect to the dividers of an underlying unit such that the posts of the stacked units do not interfere with each other.

7. A package unit of product and packaging structure wherein the product is substantially vertically stacked in layers and wherein the upper and lower surfaces of each layer are substantially planar, wherein said packaging structure comprises a divider of fairly rigid material interposed between each said layer and having opposing sides edges and end edges, wherein each divider is provided at each of its side edges with at least two tabs projecting laterally outwardly therefrom, each said tab having an aperture formed therethrough, wherein the apertures of superimposing dividers are vertically aligned, wherein posts are inserted frictionally thru the aligned apertures, wherein each divider is from about 30 in. to about 36 in. long with two tabs per side edge, and wherein each post is hollow core and formed with 3–7 layers of cardboard material, which layers are glued together to form a lightweight rigid structure.

8. The unit of claim 7 wherein said product comprises long flexible items whereby said dividers in overlapped configuration provide substantial longitudinal support thereto.

9. The unit of claim 8 positioned on at least one fork lift pallet wherein the edges of the pallet lie inside of the side edges of the dividers, wherein the posts extend above a topmost divider and below a bottom divider, and wherein the tine cavities of the pallet are oriented either laterally of longitudinally of the unit.

10. A combination of one or more of the units of claim 8 in vertically stacked arrangement wherein the dividers of an overlying unit are longitudinally staggered with respect to the dividers of an underlying unit such that the posts of the stacked units do not interfere with each other.

* * * * *